US009309899B2

(12) United States Patent
Kim et al.

(10) Patent No.: US 9,309,899 B2
(45) Date of Patent: Apr. 12, 2016

(54) CONTROL DEVICE FOR A HYDRAULIC PUMP OF CONSTRUCTION MACHINERY

(75) Inventors: Dong-Soo Kim, Jinhae-si (KR); Kyung-Sub Lee, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 436 days.

(21) Appl. No.: 13/806,545

(22) PCT Filed: Jun. 30, 2010

(86) PCT No.: PCT/KR2010/004250

§ 371 (c)(1), (2), (4) Date: Dec. 21, 2012

(87) PCT Pub. No.: WO2012/002589

PCT Pub. Date: Jan. 5, 2012

(65) Prior Publication Data

US 2013/0098022 A1 Apr. 25, 2013

(51) Int. Cl.
*F15B 11/04* (2006.01)
*F15B 1/027* (2006.01)
(Continued)

(52) U.S. Cl.
CPC ..... *F15B 1/027* (2013.01); *E02F 9/2217* (2013.01); *E02F 9/2235* (2013.01);
(Continued)

(58) Field of Classification Search
CPC ..... F15B 2211/20553; F15B 11/0423; F15B 2211/851; E02F 9/2235; E02F 9/2296; F04B 49/22; F04B 49/002
USPC ..... 60/413; 417/213, 216
See application file for complete search history.

(56) References Cited

U.S. PATENT DOCUMENTS 3,889,759 A * 6/1975 Larson ..... 172/3
3,964,262 A * 6/1976 Patton ..... 60/447
(Continued)

FOREIGN PATENT DOCUMENTS

EP 1764515 A2 3/2007
JP S61-6556 1/1986
(Continued)

OTHER PUBLICATIONS

International Search Report (in Korean and English) and Written Opinion (in Korean) for PCT/KR2010/004250, mailed Mar. 28, 2011; ISA/KR.
(Continued)

*Primary Examiner* — Nathaniel Wiehe
*Assistant Examiner* — Abiy Teka
(74) *Attorney, Agent, or Firm* — Harness, Dickey & Pierce, P.L.C.

(57) ABSTRACT

A negative control type hydraulic pump control device mounted on a construction machine such as an excavator is provided. The hydraulic pump control device includes an accumulator storing a control signal pressure, a solenoid valve supplying any one of the signal pressure from the accumulator and a negative signal pressure to the regulator when a solenoid valve is shifted in accordance with applying of the control signal, and an operation lever locking unit turning ON/OFF the control signal applied to the solenoid valve in accordance with a driver's operation, wherein an inclination angle of a swash plate of a hydraulic pump is maintained with a minimum capacity by compensating for the negative signal pressure caused by hydraulic fluid supplied from the accumulator through shifting of the solenoid valve when an engine starts.

3 Claims, 7 Drawing Sheets

(51) Int. Cl.

| | |
|---|---|
| ***E02F 9/22*** | (2006.01) |
| ***F04B 49/00*** | (2006.01) |
| ***F04B 49/22*** | (2006.01) |
| ***F15B 11/042*** | (2006.01) |

(52) U.S. Cl.

CPC ..... *E02F 9/2282* (2013.01); *E02F 9/2292* (2013.01); *E02F 9/2296* (2013.01); *F04B 49/002* (2013.01); *F04B 49/22* (2013.01); *F15B 11/0423* (2013.01); *F15B 2211/20553* (2013.01); *F15B 2211/45* (2013.01); *F15B 2211/851* (2013.01)

(56) References Cited

U.S. PATENT DOCUMENTS

| | | | | |
|---|---|---|---|---|
| 4,249,558 | A * | 2/1981 | Clifford et al. | 137/115.14 |
| 5,460,001 | A | 10/1995 | Kato et al. | |
| 6,216,456 | B1 * | 4/2001 | Mitchell | 60/452 |
| 2004/0036583 | A1 * | 2/2004 | Kajita et al. | 340/426.1 |
| 2008/0264499 | A1 * | 10/2008 | Bacon et al. | 137/563 |

FOREIGN PATENT DOCUMENTS

| | | | |
|---|---|---|---|
| JP | H04130361 | U | 11/1992 |
| JP | 05-12706 | | 2/1993 |
| JP | 2002089506 | A | 3/2002 |
| JP | 2003293400 | A | 10/2003 |
| JP | 2006206205 | A | 8/2006 |
| JP | 2006266307 | A | 10/2006 |
| JP | 2007-170485 | A | 7/2007 |
| JP | 2008 101721 | A | 5/2008 |
| JP | 2009121586 | A | 6/2009 |
| JP | 2009150413 | A | 7/2009 |
| JP | 2010071425 | A | 4/2010 |
| JP | 2011 153527 | A | 8/2011 |
| KR | 10-0184788 | B1 | 4/1999 |
| KR | 10-0205568 | B1 | 7/1999 |
| KR | 10-0297882 | B1 | 10/2001 |
| KR | 10-2007-0086781 | A | 8/2007 |

OTHER PUBLICATIONS

Office Action in corresponding Chinese Patent Application 201080067749.8 issued from the Chinese State Property Office (SIPO) dated Oct. 17, 2014.

Supplementary European Search Report from corresponding EP application No. EP 10 85 4135 dated Apr. 10, 2014.

JP Office Action issued May 13, 2014.

* cited by examiner (a)

(b)

CONTROL DEVICE FOR A HYDRAULIC PUMP OF CONSTRUCTION MACHINERY

TECHNICAL FIELD

The present invention relates to a negative control type hydraulic pump control device. More particularly, the present invention relates to a hydraulic pump control device for a construction machine such as an excavator, which can ensure a smooth engine start in a working environment, such as upland or low atmospheric temperature.

BACKGROUND ART

Generally, in order to control hydraulic fluid that is supplied to a hydraulic actuator in controlling a discharge flow rate of a variable displacement main hydraulic pump, there is a positive control system (illustrated in FIG. 1(*a*)) that controls the discharge flow rate of the hydraulic pump in proportion to signal pressure that is input to a control valve and a negative control system (illustrated in FIG. 1(*b*)) that controls the discharge flow rate of the hydraulic pump in proportion to negative signal pressure that is generated on the downstream side of the control valve.

In the case of an engine that starts by a start motor, if the work place is located on high ground or in the winter season in which atmospheric temperature is low, the capability to appropriately combine and jet fuel and air to a cylinder is lowered due to lack of oxygen or reduction of pressure. Accordingly, the initial start of the engine may not be performed smoothly.

The startability is greatly affected by a rotating speed that is initially driven by a start motor. However, in designing the start motor, its capacity is constantly limited. In particular, in the case of an excavator, various hydraulic pumps connected to an engine PTO (Power Take Off) may act as resistance loads that lower the startability, and in this case, the engine may not start.

A negative control type hydraulic pump control device in the related art as illustrated in FIG. 2 includes a variable displacement hydraulic pump 1 connected to an engine (not illustrated), a control valve 2 installed in a bypass path 3 of the hydraulic pump 1 to control a flow rate discharged from the hydraulic pump 1 in accordance with an operation of an operation lever (that is, RCV (not illustrated)), a hydraulic actuator (not illustrated) such as a boom cylinder which is driven by hydraulic fluid that is supplied when the control valve 2 is shifted, an orifice 4 installed on a downstream side of the bypass path 3 to generate negative signal pressure, and a regulator 5 operated by the negative signal pressure to control discharge flow rate through control of an inclination angle of a swash plate of the hydraulic pump 1.

In the hydraulic pump control device as described above, if an operator does not operate the operation lever RCV, a spool of the control valve 2 is in a neutral state, and all hydraulic fluid that is discharge from the hydraulic pump 1 returns to a hydraulic tank T through the orifice 4. At this time, high pressure is formed in the orifice 4, and if the negative signal pressure is high as shown in FIG. 1(*b*), the regulator 5 controls the inclination angle of the swash plate of the hydraulic pump 1 so that the discharge flow rate of the hydraulic pump 1 returns to minimum capacity.

By contrast, if the operator shifts the control valve 2 by operating the operation lever RCV, the hydraulic fluid that is discharged from the hydraulic pump 1 is supplied to the hydraulic actuator. At this time, the flow rate that passes through the bypass path 3 is gradually reduced depending on the shift amount of the spool of the control valve 2. Accordingly, the negative signal pressure that is formed in the orifice 4 is reduced, and the regulator 5 controls the inclination angle of the swash plate of the hydraulic pump 1 so that the flow rate that can drive the hydraulic actuator is discharged.

In this case, if the engine is idle, no flow rate is supplied to the bypass path 3 even in the case where the spool of the control valve 2 is maintained in a neutral position. That is, since the inclination angle of the swash plate of the hydraulic pump 1 is positioned at the inclination angle of the swash plate whereby high flow rate is initially discharged, and thus relatively high starting torque is required at the initial start of the engine.

In the construction machine on which the negative control type hydraulic pump is installed as described above, if the engine start is stopped, the inclination angle of the swash plate of the hydraulic pump is stopped with the maximum capacity.

By contrast, if the engine starts in a state where the negative signal pressure is not formed, the inclination angle of the swash plate of the hydraulic pump is in the maximum capacity state. That is, if the flow rate is low and the negative signal pressure is not sufficient when the control valve, which generates negative signal pressure at the start of the engine, is in a neutral state, the inclination angle of the swash plate of the hydraulic pump is maintained with large capacity.

Further, in the low temperature condition in the winter season, since the viscosity of the hydraulic fluid becomes high, the agitating torque becomes high, and thus the torque that is consumed when the main hydraulic pump is rotated becomes relatively higher than that on the normal condition.

DISCLOSURE

Technical Problem

Therefore, the present invention has been made to solve the above-mentioned problems occurring in the related art, and one embodiment of the present invention is related to a hydraulic pump control device for a construction machine, which can maintain an inclination angle of a swash plate of a hydraulic pump with a minimum capacity at an initial startup of an engine and thus can secure startability of the engine.

One embodiment of the present invention is related to a hydraulic pump control device for a construction machine, which can maintain an inclination angle of a swash plate of a hydraulic pump with a minimum capacity and thus can rapidly raise the number of revolutions of the engine to a set number of revolutions even if the engine is rotated with a small number of revolutions with which negative signal pressure is unable to be formed at an initial startup of an engine.

One embodiment of the present invention is related to a hydraulic pump control device for a construction machine, which can operate a hydraulic system so as to maintain an inclination angle of a swash plate of a negative control type hydraulic pump with a minimum capacity and thus can improve the startability of an engine in a working environment where it is difficult to start the engine to provide an operator convenience.

Technical Solution

In accordance with a first aspect of the present invention, there is provided a hydraulic pump control device for a construction machine including an engine, a start motor starting the engine, a variable displacement hydraulic pump connected to the engine, an operation lever generating a secondary signal pressure in proportion to an operation amount, a control valve installed in a bypass path of the hydraulic pump to control a flow rate discharged from the hydraulic pump in accordance with an operation of the operation lever, a hydraulic actuator driven by hydraulic fluid supplied when the control valve is shifted, an orifice installed on a downstream side of the bypass path to form a negative signal pressure, and a regulator controlling a discharge flow rate by controlling an inclination angle of a swash plate of the hydraulic pump, the hydraulic pump control device including an accumulator 16 storing a signal pressure of pump control; a solenoid valve supplying any one of the signal pressure from the accumulator and the negative signal pressure to the regulator when the solenoid valve is shifted in accordance with applying of a solenoid control signal; and an operation lever locking means for turning on/off the control signal applied to the solenoid valve in accordance with an operator's operation, wherein the inclination angle of the swash plate of the hydraulic pump is maintained with the minimum capacity by compensating for the negative signal pressure by means of the hydraulic fluid supplied from the accumulator through shifting of the solenoid valve when the engine starts.

In accordance with a second aspect of the present invention, there is provided a hydraulic pump control device for a construction machine including an engine, a start motor starting the engine, a variable displacement hydraulic pump connected to the engine, an operation lever generating a secondary signal pressure in proportion to an operation amount, a control valve installed in a bypass path of the hydraulic pump to control a flow rate discharged from the hydraulic pump in accordance with an operation of the operation lever, a hydraulic actuator driven by hydraulic fluid supplied when the control valve is shifted, an orifice installed on a downstream side of the bypass path to form a negative signal pressure, and a regulator controlling a discharge flow rate by controlling an inclination angle of a swash plate of the hydraulic pump, the hydraulic pump control device including: an accumulator storing a signal pressure of pump control; a solenoid valve supplying or intercepting signal pressure from the accumulator when the solenoid valve is shifted in accordance with applying of a solenoid control signal; a shuttle valve having an inlet side connected to the solenoid valve and the negative signal pressure port and an outlet side connected to the regulator port; and an operation lever locking means for turning on/off the control signal applied to the solenoid valve in accordance with a driver's operation, wherein the inclination angle of the swash plate of the hydraulic pump is maintained with a minimum capacity by compensating for the negative signal pressure by means of the hydraulic fluid supplied from the accumulator through shifting of the solenoid valve when the engine starts.

In accordance with a third aspect of the present invention, there is provided a hydraulic pump control device for a construction machine including an engine, a start motor starting the engine, a variable displacement hydraulic pump connected to the engine, an operation lever generating a secondary signal pressure in proportion to an operation amount, a control valve installed in a bypass path of the hydraulic pump to control a flow rate discharged from the hydraulic pump in accordance with an operation of the operation lever, a hydraulic actuator driven by hydraulic fluid supplied when the control valve is shifted, an orifice installed on a downstream side of the bypass path to form a negative signal pressure, and a regulator controlling a discharge flow rate by controlling an inclination angle of a swash plate of the hydraulic pump, the hydraulic pump control device including: an accumulator storing a signal pressure of a pump control; a solenoid valve supplying or intercepting signal pressure from the accumulator when the solenoid valve is shifted in accordance with applying of a solenoid control signal; a shuttle valve having an inlet side connected to the solenoid valve and the negative signal pressure port and an outlet side connected to the regulator port; an operation lever locking means for turning on/off the control signal applied to the solenoid valve in accordance with a driver's operation; and a controller receiving an operation signal of the operation lever locking means, and if the operation lever locking means is shifted to a locking position, transferring the control signal to the solenoid valve, wherein the inclination angle of the swash plate of the hydraulic pump is maintained with a minimum capacity by compensating for the negative signal pressure by means of the hydraulic fluid supplied from the accumulator through shifting of the solenoid valve when the engine starts.

In accordance with a fourth aspect of the present invention, there is provided a hydraulic pump control device for a construction machine including an engine, a start motor starting the engine, a variable displacement hydraulic pump connected to the engine, an operation lever generating a secondary signal pressure in proportion to an operation amount, a control valve installed in a bypass path of the hydraulic pump to control a flow rate discharged from the hydraulic pump in accordance with an operation of the operation lever, a hydraulic actuator driven by hydraulic fluid supplied when the control valve is shifted, an orifice installed on a downstream side of the bypass path to form a negative signal pressure, and a regulator controlling a discharge flow rate by controlling an inclination angle of a swash plate of the hydraulic pump, the hydraulic pump control device including: an accumulator storing a signal pressure of a pump control; a solenoid valve supplying or intercepting signal pressure from the accumulator when the solenoid valve is shifted in accordance with applying of a solenoid control signal; a shuttle valve having an inlet side connected to the solenoid valve and the negative signal pressure port and an outlet side connected to the regulator port; an operation lever locking means for turning on/off the control signal applied to the solenoid valve in accordance with a driver's operation; and a relay receiving power when the operation lever locking means is shifted to a locking position, having an output end connected in parallel to signals of the solenoid valve and a relay driving unit, and driven by an input signal from an engine start key, wherein the inclination angle of the swash plate of the hydraulic pump is maintained with a minimum capacity by compensating for the negative signal pressure by means of the hydraulic fluid supplied from the accumulator through shifting of the solenoid valve when the engine starts.

In accordance with the aspects of the present invention, the hydraulic pump control device may further include a pilot pump connected to the engine to supply the signal pressure to the regulator through the solenoid valve when a safety lever of the operation lever locking means is shifted to a locking position.

The solenoid valve may include a three-port solenoid valve so as to connect any one of the accumulator port and the negative signal pressure port to the regulator port, and during shifting, the solenoid valve may connect the accumulator port to the regulator port or connect the negative signal pressure port to the regulator port.

The operation lever locking means may include a switch which is switched on to supply the control signal to the solenoid valve so that the solenoid valve is shifted when the safety lever is shifted to a locking position.

The controller may receive a signal from an engine start key, and if the engine start key is operated, the controller may supply the control signal to shift the solenoid valve, while if the operation signal of the operation lever locking means is shifted to a release state, the controller may intercept power applied to the solenoid valve.

Advantageous Effect

The hydraulic pump control device for a construction machine, as configured above according to the aspects of the present invention, has the following advantages.

The inclination angle of the swash plate of the hydraulic pump is controlled with the minimum measurement rate at the initial startup of the engine and thus the engine startability is improved.

In the case of working in a working environment where the engine startability is low, the operator can drive the working device only by the working device operation pattern in a general working environment that is a working environment except for low atmospheric temperature and high ground.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
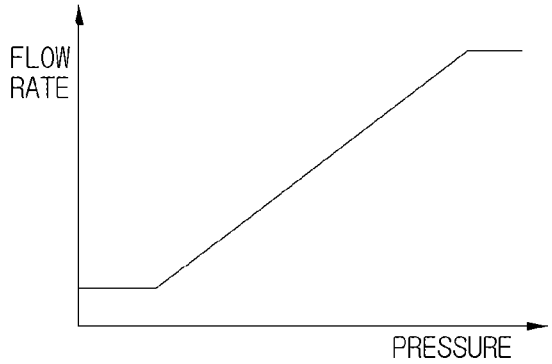
FIGS. 1(*a*) and 1(*b*) are graphs showing positive and negative control methods to control the flow rate of a hydraulic pump.
Figure 1:
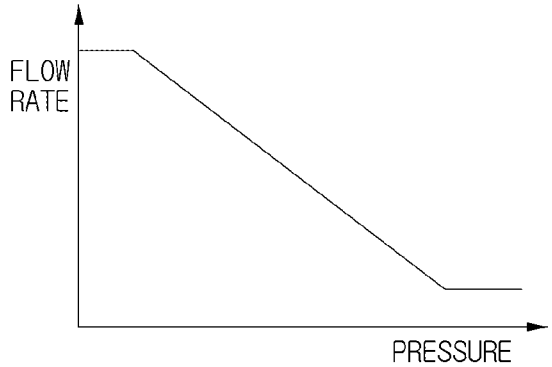
Figure 2:
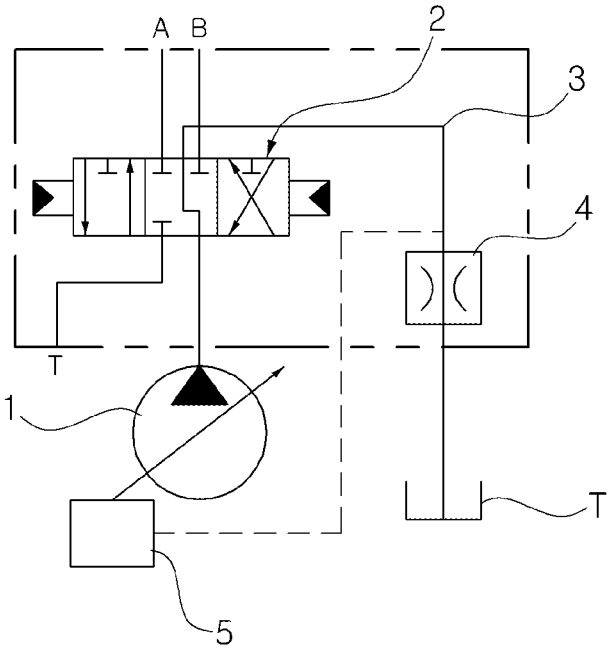
FIG. 2 is a hydraulic circuit diagram of a hydraulic pump control device for a construction machine in the related art.

10: engine
11: variable displacement hydraulic pump
12: bypass path
13: control valve
15: regulator
16: accumulator
17: solenoid valve
18: pilot pump
19: operation lever locking means
20: switch
21: shuttle valve
22: controller (ECU)
23: engine start key

BEST MODE

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 3:
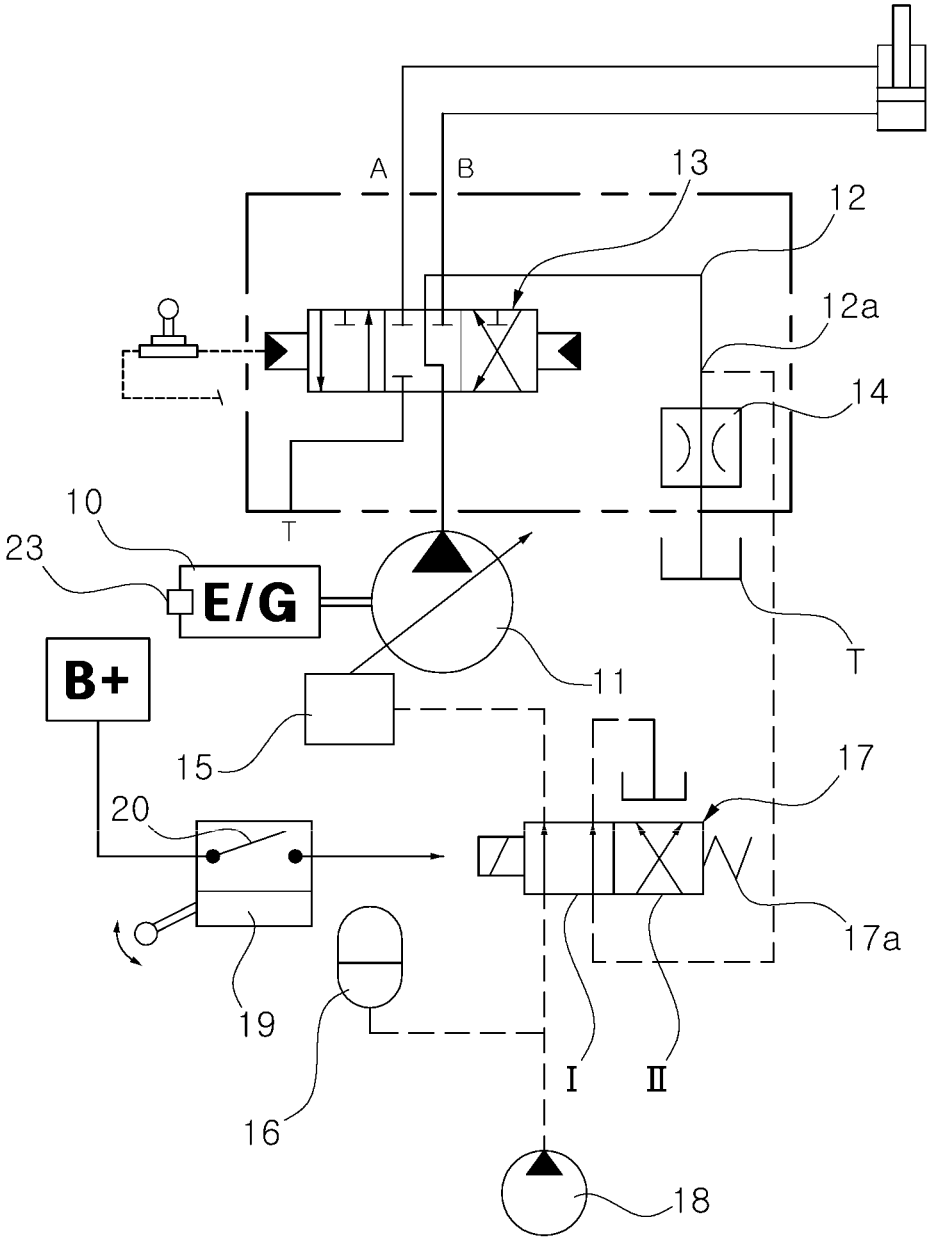
FIG. 3 is a hydraulic circuit diagram of a hydraulic pump control device for a construction machine according to a first embodiment of the present invention.

According to a first embodiment of the present invention as illustrated in FIG. 3, there is provided a hydraulic pump control device for a construction machine including an engine 10, a start motor starting the engine 10, a variable displacement hydraulic pump 11 connected to the engine 10, an operation lever RCV generating a secondary signal pressure in proportion to an operation amount thereof, a control valve 13 installed in a bypass path 12 of the hydraulic pump 11 to control a flow rate discharged from the hydraulic pump 11 in accordance with an operation of the operation lever, a hydraulic actuator (for example, boom cylinder or the like) driven by hydraulic fluid supplied when the control valve 13 is shifted, an orifice 14 installed on a downstream side of the bypass path 12 to form a negative signal pressure, and a regulator 15 controlling a discharge flow rate by controlling an inclination angle of a swash plate of the hydraulic pump 11, the hydraulic pump control device including: an accumulator 16 storing a signal pressure of pump control; a solenoid valve 17 supplying any one of the signal pressure from the accumulator 16 and the negative signal pressure to the regulator 15 when the solenoid valve 17 is shifted in accordance with applying of a solenoid control signal; and an operation lever locking means 19 (for example, safety lever) for turning on/off the control signal applied to the solenoid valve 17 in accordance with an operator's operation, wherein the inclination angle of the swash plate of the hydraulic pump 11 is maintained with the minimum capacity by compensating for the negative signal pressure by means of the hydraulic fluid supplied from the accumulator 16 through shifting of the solenoid valve 17 when the engine starts.

The hydraulic pump control device, according to the first embodiment of the present invention, may further include a pilot pump 18 connected to the engine 10 to supply the signal pressure to the regulator 15 through the solenoid valve 17 when the operation lever locking means 19 is shifted to a locking position.

The solenoid valve 17 may include a three-port solenoid valve so as to connect any one of the accumulator port and the negative signal pressure port 12*a* to the regulator port, and during shifting, the solenoid valve connects the accumulator port to the regulator port (I) or connects the negative signal pressure port 12*a* to the regulator port (II).

The operation lever locking means 19 includes a switch 20 which is switched on to supply the control signal to the solenoid valve 17 so that the solenoid valve is shifted when a safety lever of the operation lever locking means 19 is shifted to a locking position (that is, the safety lever is moved down to a bottom side of a cab).

Hereinafter, the use example of the hydraulic pump control device for a construction machine according to the first embodiment of the present invention will be described.

As shown in FIG. 3, if an operator starts the engine, a spool of the control valve 13 is maintained in a neutral state, and hydraulic fluid that is discharged from the hydraulic pump 11 passes through the control valve 13 and the orifice 14 and returns to the hydraulic tank T. At this time, since the safety lever of the operation lever locking means 19 is maintained in a locking position (a start circuit is designed to start when the safety lever of the operation lever locking means 19 is maintained in the locking position), the solenoid valve 17 is shifted (shifted to a state illustrated in the drawing) by an electric signal from the switch 20 that is installed on the operation lever locking means 19.

Through this, the signal pressure from the accumulator 16 or the pilot pump 18 is supplied to the regulator 15 through the shifted solenoid valve 17. That is, at the start of the engine 10, the negative signal pressure of the control valve 13 is compensated for by the signal pressure that is supplied from the accumulator 16 or the pilot pump 18, and thus the inclination angle of the swash plate of the hydraulic pump 11 is maintained with the minimum capacity.

Accordingly, the inclination angle of the swash plate of the hydraulic pump 11 is shifted to the minimum state, and the flow rate discharged from the hydraulic pump 11 is maintained with the minimum capacity. Through this, even if the negative signal pressure of the control valve 13 is low at the start of the engine 10, the inclination angle of the swash plate of the hydraulic pump 11 is maintained with the minimum state, and thus the startability can be improved.

By contrast, if the operator operates the operation lever (in this case, the safety lever is horizontally lifted to intercept the power supply) after the start of the engine, the switch 20 installed on the operation lever locking means 19 is opened (in an off state), and the solenoid valve 17 returns to its initial state by the elastic force of a valve spring 17*a*.

Through this, the signal pressure from the accumulator 16 or the pilot pump 18 is intercepted, and the negative signal pressure of the control valve 13 is supplied to the regulator 15 through the solenoid valve 17. Accordingly, the operator can adjust the discharge flow rate of the hydraulic pump 11 according to the operation of the operation lever RCV.

Figure 4:
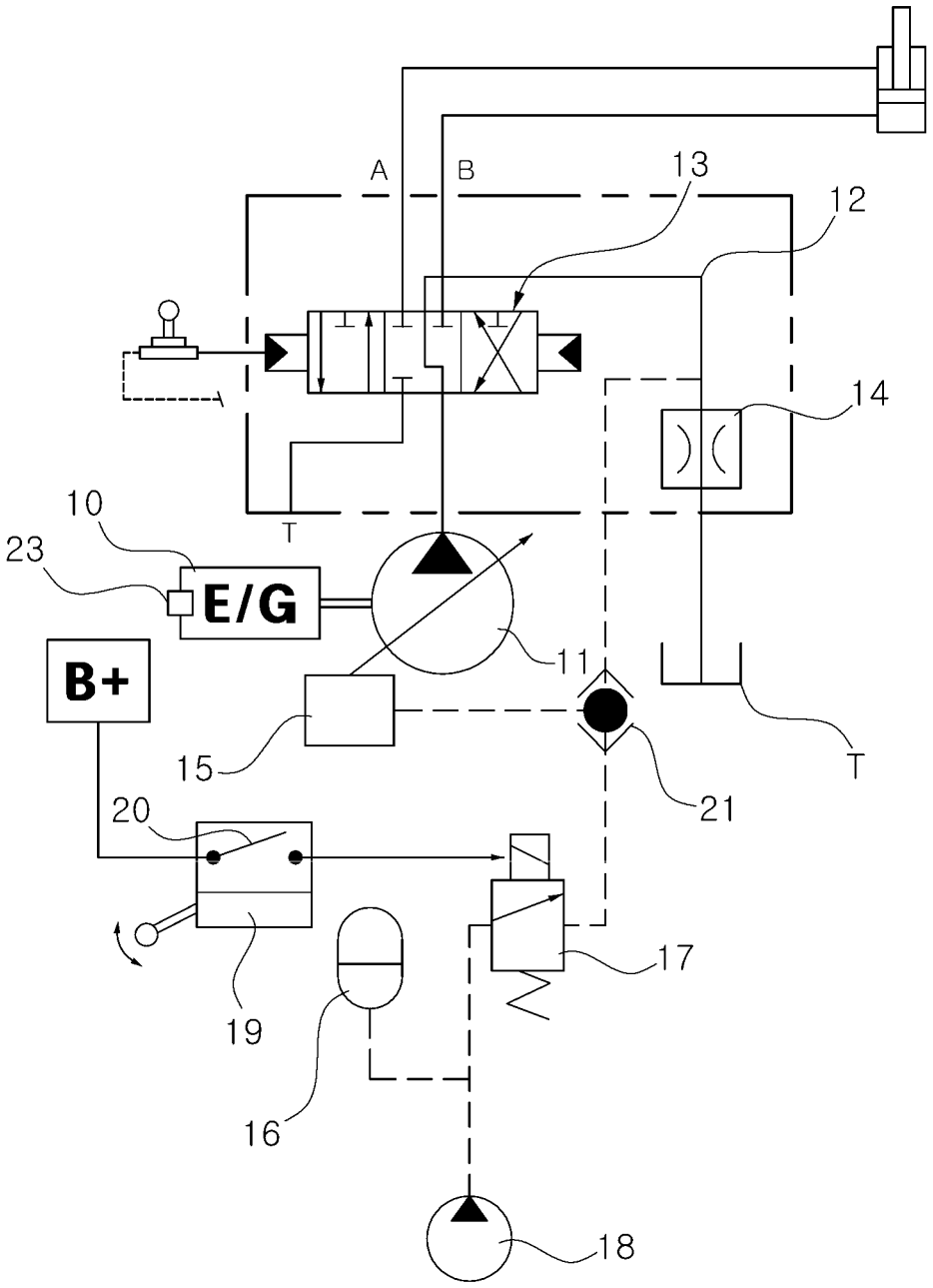
FIG. 4 is a hydraulic circuit diagram of a hydraulic pump control device for a construction machine according to a second embodiment of the present invention.

According to a second embodiment of the present invention as illustrated in FIG. 4, there is provided a hydraulic pump control device for a construction machine including an engine 10, a start motor starting the engine 10, a variable displacement hydraulic pump 11 connected to the engine, an operation lever RCV generating a secondary signal pressure in proportion to an operation amount, a control valve 13 installed in a bypass path 12 of the hydraulic pump 11 to control a flow rate discharged from the hydraulic pump 11 in accordance with an operation of the operation lever, a hydraulic actuator driven by hydraulic fluid supplied when the control valve 13 is shifted, an orifice 14 installed on a downstream side of the bypass path 12 to form a negative signal pressure, and a regulator 15 controlling a discharge flow rate by controlling an inclination angle of a swash plate of the hydraulic pump 11, the hydraulic pump control device including an accumulator 16 storing a signal pressure of pump control; a solenoid valve 17 supplying or intercepting signal pressure from the accumulator 16 when the solenoid valve 17 is shifted in accordance with applying of a solenoid control signal; a shuttle valve 21 having an inlet side connected to the solenoid valve 17 and the negative signal pressure port 12*a* and an outlet side connected to the regulator port to output higher pressure of the negative signal pressure and the signal pressure that passes through the solenoid valve 17 to the regulator 15; and an operation lever locking means 19 for turning on/off the control signal applied to the solenoid valve 17 in accordance with a driver's operation, wherein the inclination angle of the swash plate of the hydraulic pump 11 is maintained with a minimum capacity by compensating for the negative signal pressure by means of the hydraulic fluid supplied from the accumulator 16 through shifting of the solenoid valve 17 when the engine starts.

In the hydraulic pump control device according to the second embodiment of the present invention as constructed above, if the operator starts the engine, the safety lever of the operation lever locking means 19 is maintained in the locking position (that is, the safety lever is moved down to the bottom side of the cab). Through this, the solenoid valve 17 is shifted by an electric signal from the switch 20 that is installed on the operation lever locking means 19.

Through this, the control signal pressure from the accumulator 16 or the pilot pump 18 is supplied to the regulator 15 through the shifted solenoid valve 17 and the shuttle valve 21. That is, at the start of the engine 10, the negative signal pressure of the control valve 13 is compensated for by the signal pressure that is supplied from the accumulator 16 or the pilot pump 18, and thus the inclination angle of the swash plate of the hydraulic pump 11 is maintained with the minimum capacity.

Accordingly, at the start of the engine 10, the inclination angle of the swash plate of the hydraulic pump 11 is shifted to the minimum state even if the negative signal pressure of the control valve 13 is low, and thus the startability can be improved.

By contrast, if the operator horizontally shifts the safety lever of the operation lever locking means 19 (released from the locking position) after the start of the engine 10, the electric signal that is applied from the switch 20 that is installed on the operation lever locking means 19 to the solenoid valve 17 is intercepted.

Through this, the signal pressure from the accumulator 16 or the pilot pump 18 is intercepted, and the negative signal pressure of the control valve 13 is supplied to the regulator 15 through the shuttle valve 21. Accordingly, the operator can adjust the required discharge flow rate of the hydraulic pump 11 according to the operation of the operation lever.

Figure 5:
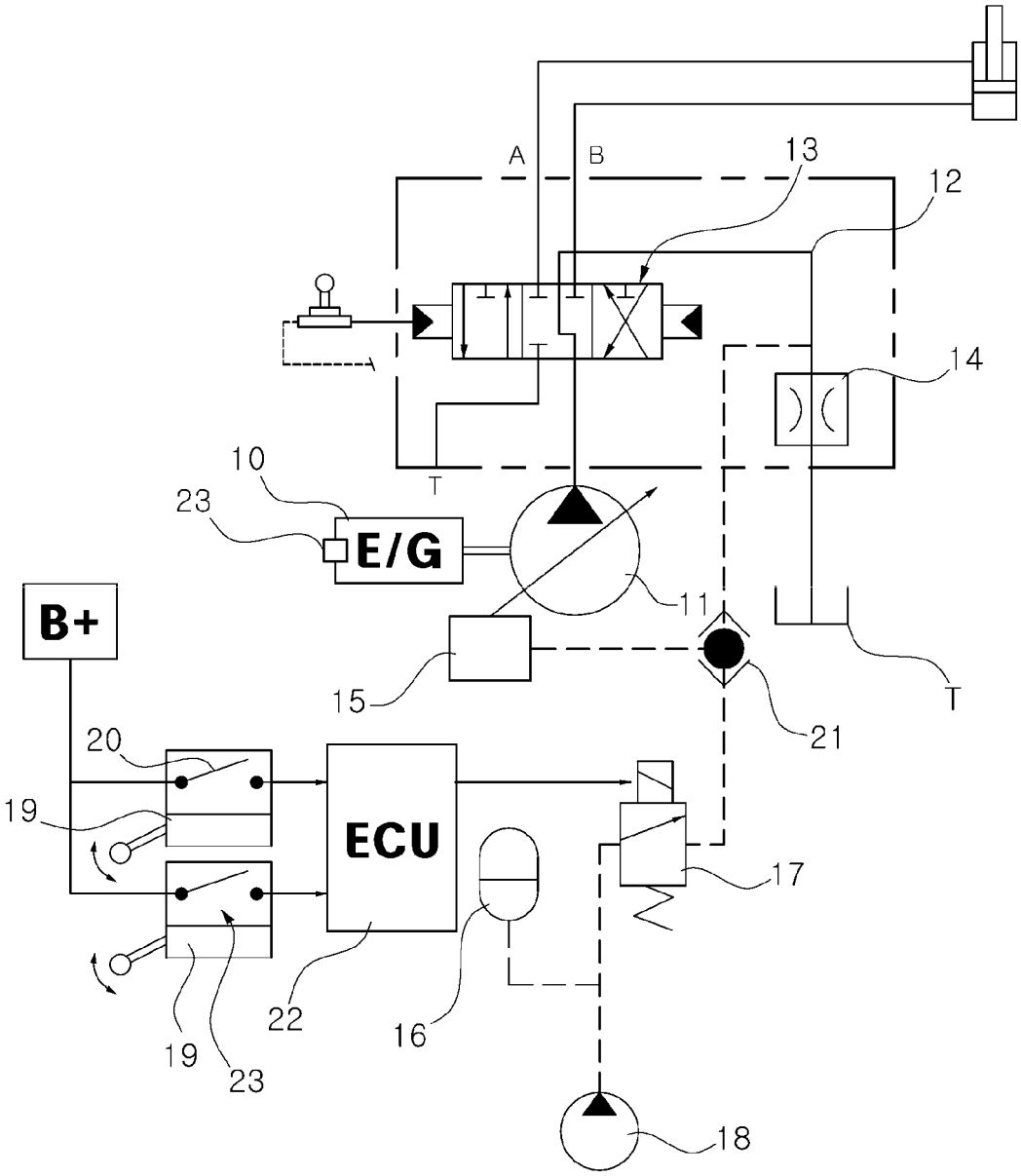
FIG. 5 is a hydraulic circuit diagram of a hydraulic pump control device for a construction machine according to a third embodiment of the present invention.

According to a third embodiment of the present invention as illustrated in FIG. 5, there is provided a hydraulic pump control device for a construction machine including an engine 10, a start motor starting the engine 10, a variable displacement hydraulic pump 11 connected to the engine 10, an operation lever generating a secondary signal pressure in proportion to an operation amount, a control valve 13 installed in a bypass path 12 of the hydraulic pump 11 to control a flow rate discharged from the hydraulic pump in accordance with an operation of the operation lever RCV, a hydraulic actuator driven by hydraulic fluid supplied when the control valve 13 is shifted, an orifice 14 installed on a downstream side of the bypass path 12 to form a negative signal pressure, and a regulator 15 controlling a discharge flow rate by controlling an inclination angle of a swash plate of the hydraulic pump 11, the hydraulic pump control device including an accumulator 16 storing a signal pressure of a/the pump control; a solenoid valve 17 supplying or intercepting signal pressure from the accumulator 16 when the solenoid valve 17 is shifted in accordance with the applying of a solenoid control signal; a shuttle valve 21 having an inlet side connected to the solenoid valve 17 and the negative signal pressure port 12*a* and an outlet side connected to the regulator port to output higher pressure of the negative signal pressure and the signal pressure that passes through the solenoid valve 17 to the regulator 15; an operation lever locking means 19 for turning on/off the control signal applied to the solenoid valve 17 in accordance with a driver's operation; and a controller (ECU) 22 receiving an operation signal of the operation lever locking means 19, and if the operation lever locking means 19 is shifted to a locking position, transferring the control signal to the solenoid valve 17 to shift the solenoid valve 17, wherein the inclination angle of the swash plate of the hydraulic pump 11 is maintained with a minimum capacity by compensating for the negative signal pressure by means of the hydraulic fluid supplied from the accumulator 16 through shifting of the solenoid valve 17 when the engine starts.

If a signal is input from an engine start key 23 and the start key 23 is operated, the controller 22 supplies the solenoid control signal to the solenoid valve 17 to shift the solenoid valve 17, and if the operation signal of the operation lever locking means 19 is shifted from the locking position to a release position, the controller 22 intercepts the power that is supplied to the solenoid valve 17.

According to the hydraulic pump control device according to the first and second embodiments of the present invention, the solenoid valve 17 or the shuttle valve 21 is unnecessarily operated whenever the safety lever of the operation lever locking means 19 is operated although the valves have functions that are necessary only at the start of the engine. Accordingly, the durability of the valves is lowered, and in the case of repeatedly operating the operation lever locking means 19 before the start of the engine 10, the pressure of the accumulator 16 may be lost.

According to the hydraulic pump control device according to the third embodiment of the present invention, if the operator's operation state of the operation lever locking means 19 is input and the engine start switch 23 is input at the start of the engine 10, the solenoid valve 17 is shifted by the control signal from the controller 22, and the signal pressure of the accumulator 16 or the pilot pump 18 may be supplied to the regulator 15.

Specifically, when the key is initially turned on, the controller 22 outputs an OFF signal to a signal port of the solenoid 17, and when a start key signal of the engine 10 is turned on, the controller 22 outputs an ON signal to the signal port of the solenoid valve 17 to shift the solenoid valve 17.

Through the shifting of the solenoid valve 17, the signal pressure from the accumulator 16 or the pilot pump 18 is supplied to the regulator 15 through the shuttle valve 21. That is, if the safety lever of the operation lever locking means 19 is shifted to the locking position and the engine start key 23 starts, the negative signal pressure of the control valve 13 is compensated for by the signal pressure that is supplied from the accumulator 16 or the pilot pump 18. Through this, since the inclination angle of the swash plate of the hydraulic pump 11 is shifted to the minimum capacity state, the initial start of the engine becomes easy, and thus the startability can be improved.

In a working environment where the start of the engine 10 is not easy, such as low atmospheric temperature or high ground, it may take a considerably longer time until the revolution of the engine 10 rises to a normal state. In this case, it is necessary to continuously control the inclination angle of the swash plate of the hydraulic pump until the negative signal pressure of the control valve 13 is maintained in a normal range.

Due to such characteristics, even in the case where the engine start key 23 is turned off and the start of the start motor is stopped, it is necessary to continuously maintain the shift state of the solenoid valve 17 so that the signal pressure of the accumulator 16 is continuously supplied to the regulator 15.

Figure 7:
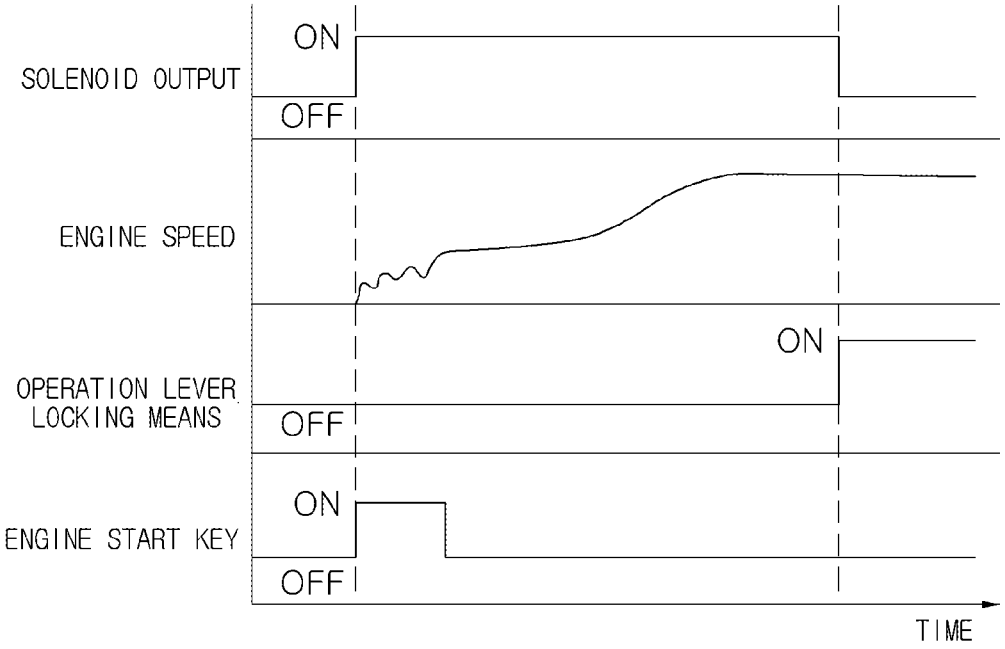
FIG. 7 is a graph explaining a hydraulic pump control device for a construction machine according to an embodiment of the present invention.

On the other hand, as shown in FIG. 7, if the operator releases the safety lever of the operation lever locking means 19 from the locking position (that is, if the operator horizontally lifts up the safety lever) to operate a working device such as a boom, the solenoid valve 17 is immediately turned off according to the control signal from the controller 22, and thus the required discharge flow rate of the hydraulic pump 11 can be adjusted according to the operator's operation of the operation lever RCV.

Figure 6:
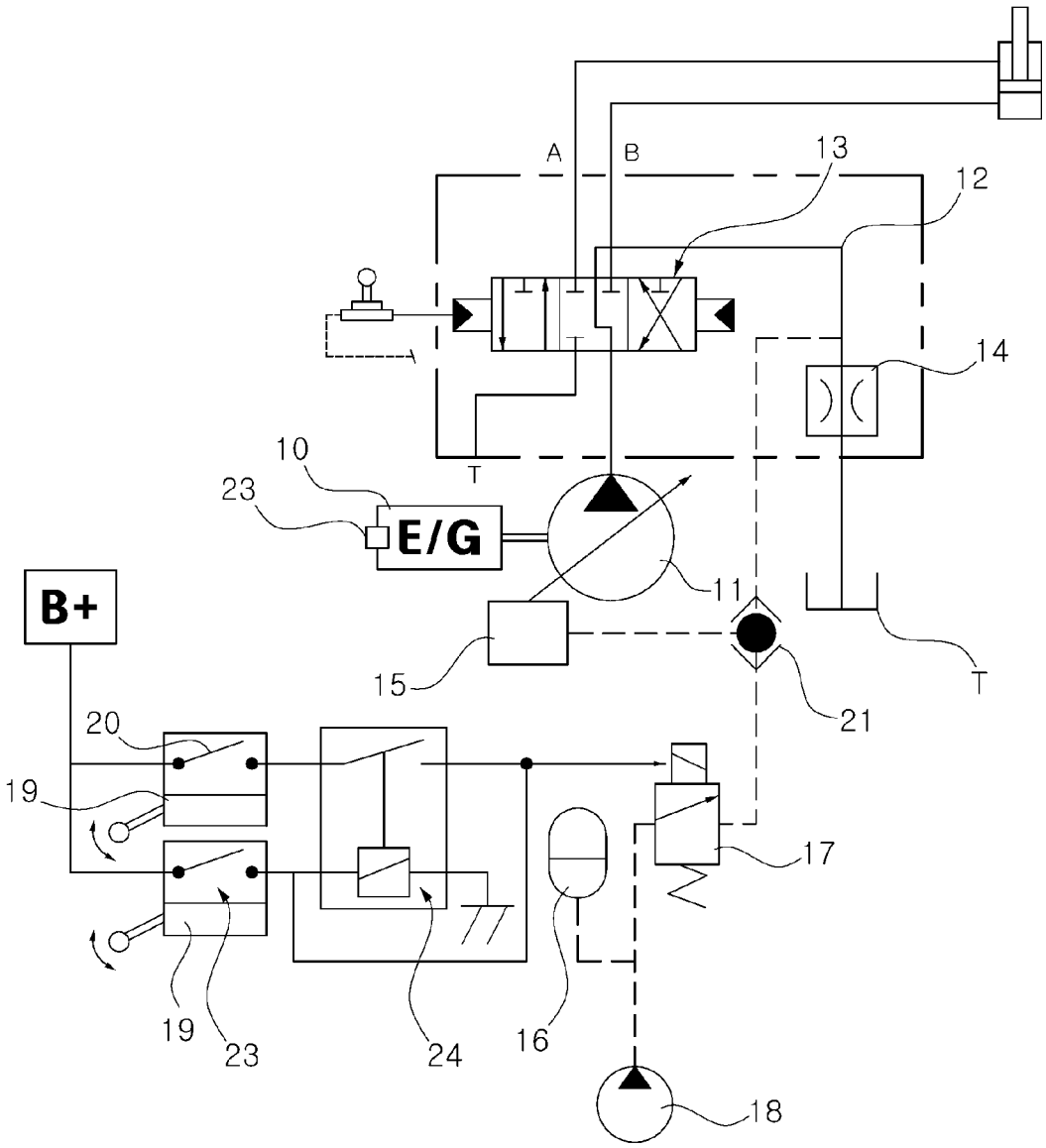
FIG. 6 is a hydraulic circuit diagram of a hydraulic pump control device for a construction machine according to a fourth embodiment of the present invention.

According to a fourth embodiment of the present invention as illustrated in FIG. 6, there is provided a hydraulic pump control device for a construction machine including an engine 10, a start motor starting the engine 10, a variable displacement hydraulic pump 11 connected to the engine 10, an operation lever RCV generating a secondary signal pressure in proportion to an operation amount, a control valve 13 installed in a bypass path 12 of the hydraulic pump 11 to control a flow rate discharged from the hydraulic pump 11 in accordance with an operation of the operation lever, a hydraulic actuator driven by hydraulic fluid supplied when the control valve 13 is shifted, an orifice 14 installed on a downstream side of the bypass path 12 to form a negative signal pressure, and a regulator 15 controlling a discharge flow rate by controlling an inclination angle of a swash plate of the hydraulic pump 11, the hydraulic pump control device including an accumulator 16 storing a signal pressure of pump control; a solenoid valve 17 supplying or intercepting signal pressure from the accumulator 16 when the solenoid valve 17 is shifted in accordance with applying of a solenoid control signal; a shuttle valve 21 having an inlet side connected to the solenoid valve and the negative signal pressure port 12*a* and an outlet side connected to the regulator port to selectively output higher pressure of the signal pressure that passes through the solenoid valve 17 and the negative signal pressure to the regulator 15; an operation lever locking means 19 for turning ON/OFF the control signal applied to the solenoid valve 17 in accordance with a driver's operation; and a relay 24 having an output end connected in parallel to respective signals of the solenoid valve 17 and a relay driving unit, and driven by an input signal from an engine start key 23, wherein the inclination angle of the swash plate of the hydraulic pump 11 is maintained with a minimum capacity by compensating for the negative signal pressure by means of the hydraulic fluid supplied from the accumulator 16 through shifting of the solenoid valve 17 when the engine starts.

In the hydraulic pump control device according to the fourth embodiment of the present invention, if the operator starts the engine, the safety lever of the operation lever locking means 19 is maintained in the locking position (that is, the safety lever is moved down to a bottom side of a cab), and the relay 24 is driven by the input signal of the engine start key 23.

Since the output side of the relay 24 is connected parallelly to the respective signals of the solenoid valve 17 and the relay driving unit, the relay driving state is maintained after the engine start by the engine start key 23.

Since the solenoid valve 17 is shifted by the driving of the relay 24, the signal pressure from the accumulator 16 or the pilot pump 18 is supplied to the regulator 15 through the solenoid valve 17 and the shuttle valve 21.

That is, at the start of the engine 10, the negative signal pressure of the control valve 13 is compensated for by the signal pressure that is supplied from the accumulator 16 or the pilot pump 18, and thus the inclination angle of the swash plate of the hydraulic pump 11 is maintained with the minimum capacity.

On the other hand, if the safety lever of the operation lever locking means 19 is shifted from the locking position to the release state (if the safety lever is horizontally shifted by the operator), the solenoid control signal that is applied to the solenoid valve 17 is intercepted.

Through this, the inclination angle of the swash plate of the hydraulic pump 11 can be controlled by driving the regulator with the negative signal pressure of the control valve 13 that is supplied through the shuttle valve 21. Accordingly, the operator can adjust the required discharge flow rate of the hydraulic pump 11 according to the operation of the operation lever.

INDUSTRIAL APPLICABILITY

As apparent from the above description, according to the hydraulic pump control device for a construction machine according to the embodiments of the present invention, the inclination angle of the swash plate of the hydraulic pump can be controlled with the minimum capacity at the initial startup or the start of the engine, and thus the engine startability can be improved. In the case of working in a working environment, such as low atmospheric temperature or high ground, the operator can drive the working device only by the working device operation pattern in a general working environment.

The invention claimed is:

1. A hydraulic pump control device for a construction machine including an engine, a variable displacement hydraulic pump connected to the engine, an operation lever generating a secondary signal pressure in proportion to an operation amount, a control valve installed in a bypass path of the hydraulic pump to control a flow rate discharged from the hydraulic pump in accordance with an operation of the operation lever, a hydraulic actuator driven by hydraulic fluid supplied when the control valve is shifted, an orifice installed on a downstream side of the bypass path to form a negative signal pressure, and a regulator controlling a discharge flow rate by controlling an inclination angle of a swash plate of the hydraulic pump, the hydraulic pump control device comprising:

an accumulator storing a signal pressure of pump control;

a solenoid valve movable between a first position and a second position, in the first position the solenoid valve directs through the solenoid valve signal pressure from the accumulator to the regulator, in the second position the solenoid valve directs through the solenoid valve the negative signal pressure generated by the orifice to the regulator; and a safety lever configured to be manually actuated by an operator to apply a solenoid control signal to the solenoid valve for moving the solenoid valve between the first position and the second position, wherein movement of the solenoid valve manually by the operator during engine start to the first position to direct signal pressure from the accumulator to the regulator results in the regulator maintaining the inclination angle of the swash plate of the hydraulic pump at minimum capacity by compensating for the negative signal pressure; and the safety lever comprises a switch which is switched on to supply the solenoid control signal to the solenoid valve so that the solenoid valve is shifted when the safety lever is shifted to a locking position.

2. The hydraulic pump control device according to claim 1, further comprising a pilot pump connected to the engine to supply the signal pressure to the regulator through the solenoid valve when a the safety lever is shifted to a locking position.

3. The hydraulic pump control device according to claim 1, wherein the solenoid valve comprises a three-port solenoid valve so as to connect any one of the accumulator and the negative signal pressure to the regulator, and during shifting, the solenoid valve connects the accumulator to the regulator or connects the negative signal pressure to the regulator.

* * * * *